US009132478B2

(12) United States Patent
Müller et al.

(10) Patent No.: US 9,132,478 B2
(45) Date of Patent: Sep. 15, 2015

(54) CAST IRON ALLOY FOR CYLINDER HEADS

(75) Inventors: Hans Müller, Dormitz (DE); Ulf Schmidtgen, Fürth (DE); Falk Schönfeld, Cadolzburg (DE)

(73) Assignee: MAN TRUCK & BUS AG, Munich (DE)

( * ) Notice: Subject to any disclaimer, the term of this patent is extended or adjusted under 35 U.S.C. 154(b) by 409 days.

(21) Appl. No.: 12/920,246

(22) PCT Filed: Jan. 11, 2010

(86) PCT No.: PCT/EP2010/000089

§ 371 (c)(1),
(2), (4) Date: Nov. 29, 2010

(87) PCT Pub. No.: WO2010/079146

PCT Pub. Date: Jul. 15, 2010

(65) Prior Publication Data

US 2011/0132314 A1 Jun. 9, 2011

(30) Foreign Application Priority Data

Jan. 9, 2009 (DE) ..... 10 2009 004 189

(51) Int. Cl.
*C22C 37/06* (2006.01)
*C22C 37/08* (2006.01)
(Continued)

(52) U.S. Cl.
CPC ..... *B22D 19/0009* (2013.01); *C22C 37/06* (2013.01); *C22C 37/08* (2013.01); *C22C 37/10* (2013.01); *F05C 2251/048* (2013.01)

(58) Field of Classification Search
CPC .... B22D 19/0009; C22C 37/06; C22C 37/08; C22C 37/10
USPC ..... 123/193.5; 420/15, 17
See application file for complete search history.

(56) References Cited

U.S. PATENT DOCUMENTS 5,948,353 A 9/1999 Lawrence et al.
6,511,554 B1 * 1/2003 Kawano et al. ..... 148/324
(Continued)

FOREIGN PATENT DOCUMENTS

CN 1176315 A 3/1998
CN 1759197 A 4/2006
CN 101289725 A 10/2008
(Continued)

OTHER PUBLICATIONS

O'Rourke, Robert; Cast Iron: The Engineered Metal; Jan. 2001 Advanced Materials & Processes; pp. 65-68.*
(Continued)

*Primary Examiner* — Lindsay Low
*Assistant Examiner* — Jacob Amick
(74) *Attorney, Agent, or Firm* — Leason Ellis LLP

(57) ABSTRACT

A lamellar graphite cast iron alloy is described which, as additives, has 2.80% by weight-3.60% by weight carbon (C), 1.00% by weight-1.70% by weight silicon (Si), 0.10% by weight-1.20% by weight manganese (Mn), 0.03% by weight-0.15% by weight sulphur (S), 0.05% by weight-0.30% by weight chromium (Cr), 0.05% by weight-0.30% by weight molybdenum (Mo), 0.05% by weight-0.20% by weight tin (Sn) and the usual impurities, and also described is a cylinder head which can be obtained therefrom.

12 Claims, 1 Drawing Sheet

(51) Int. Cl.
*C22C 37/10* (2006.01)
*B22D 19/00* (2006.01)

(56) References Cited

U.S. PATENT DOCUMENTS

| | | | | |
|---|---|---|---|---|
| 2006/0008377 | A1 | 1/2006 | Eriksson et al. | |
| 2006/0283526 | A1* | 12/2006 | Liang | 148/324 |

FOREIGN PATENT DOCUMENTS

| | | | |
|---|---|---|---|
| DE | 2428821 | A1 | 12/1975 |
| DE | 10012918 | | 9/2001 |
| DE | 102005010090 | | 9/2006 |
| EP | 0616040 | | 9/1994 |
| GB | 893528 | | 4/1962 |
| WO | WO 2004/083474 | | 9/2004 |
| WO | WO 2004083474 | A1 * | 9/2004 |

OTHER PUBLICATIONS

R.B. Gundlach; Temperaturewechselbestandigkeit von legierten Gusseisen mit Lamellengraphit fur Bauteile von Dieselmortoren, Giesserei-Praxis, Nr. 6, Mar. 25, 1981, pp. 97-107.

* cited by examiner

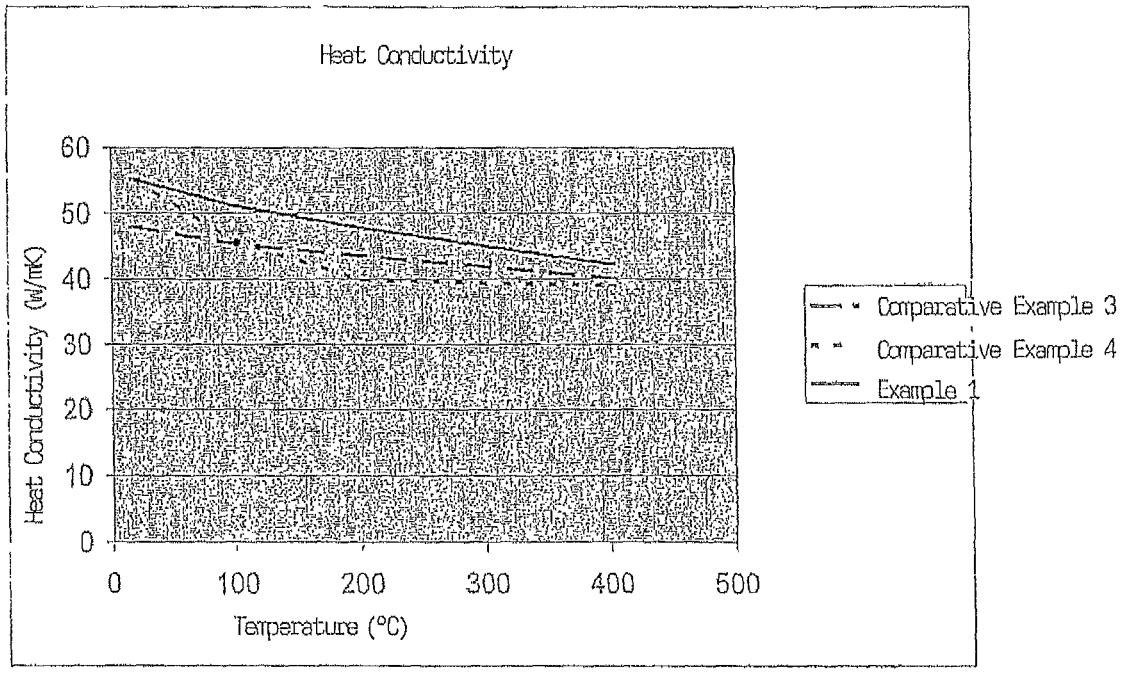
Heat Conductivity
Heat Conductivity (W/mK)
60
50
40
30
20
10
0
0
100
200
300
400
500
Temperature (°C)
Comparative Example 3
Comparative Example 4
Example 1

CAST IRON ALLOY FOR CYLINDER HEADS

CROSS-REFERENCE TO PRIOR APPLICATION

This is a U.S. National Phase application under 35 U.S.C. §371 of International Application No. PCT/EP2010/000089, filed Jan. 11, 2010, which claims the benefit of German Patent Application No. 10 2009 004 189.3, filed Jan. 9, 2009, both of which are incorporated herein by reference.

The invention relates to a lamellar graphite cast iron alloy and a cylinder head cast therefrom.

Cast iron alloys or cylinder heads of this type are known. A cylinder head for an internal combustion engine is known, for example, from DE-A-100 12 918. The latter describes a cylinder head for an internal combustion engine which is cast from alloyed lamellar graphite cast iron and, as additives, contains 3.30% by weight to 3.60% by weight carbon, 1.73% by weight to 1.92% by weight silicon, 0.60% by weight to 0.90% by weight manganese, a maximum of 0.055% by weight phosphorus, a maximum of 0.10% by weight sulphur, 0.20% by weight to 0.32% by weight chromium, 0.40% by weight to 0.90% by weight copper, 0.08% by weight to 0.10% by weight tin, 0.035% by weight to 0.55% by weight molybdenum and 0.01% by weight to 0.014% by weight titanium. Furthermore, cylinder heads made of alloyed grey cast iron are known, for example from the MAN works standard M 3422, April 2000, which, as additives, contain 3.30% by weight to 3.55% by weight carbon, 1.80% by weight to 2.30% by weight silicon, 0.55% by weight to 0.80% by weight manganese, a maximum of 0.20% by weight phosphorus, a maximum of 0.13% by weight sulphur, 0.10% by weight to 0.15% by weight chromium, 0.10% by weight to 0.20% by weight molybdenum, 0.08% by weight to 0.12% by weight tin and a maximum of 0.15% by weight copper.

The ignition pressures within the cylinder are constantly being further increased for the constant improvement of combustion in engines. The weakest region here is the valve crosspiece of the cylinder head closing the combustion chamber. Although various methods are known to adjust the desired properties by the adding of specific alloy elements, there has not, however, been any success until now in providing cast iron alloys or cylinder heads which satisfy the increased requirements in relation to the mechanical properties and with regard to the heat conductivity, in particular with regard to the fatigue limit or service life. In addition to this there is the fact that known alloys require the adding of expensive alloy elements.

The invention was therefore based on the object of developing the alloys or cylinder heads described at the outset in such a way that the described drawbacks are substantially ruled out. In this case, it should be possible, in particular, to provide an alloy or a cylinder head, which has improved mechanical properties and an improved heat conductivity, in particular at low temperatures, i.e. at temperatures of about 100 to about 400. It is also desirable to lower the costs of known alloys or cylinder heads.

The above object is achieved by a lamellar graphite cast iron alloy, which is characterised in that the cast iron, as additives, has 2.80% by weight-3.60 by weight carbon (0), 1.00% by weight-1.70% by weight silicon (Si), 0.10% by weight-1.20% by weight manganese (Mn), 0.03% by weight-0.15% by weight sulphur (5), 0.05% by weight-0.30% by weight chromium (Cr), 0.05% by weight-0.30% by weight molybdenum (Mo), 0.05% by weight-0.20% by weight tin (Sn) and the usual impurities.

Advantageous configurations of this cast iron alloy, in particular its use as a cylinder head, emerge from the following still more closely described sub-claims 2 to 9.

The alloy according to the invention or the cylinder head according to the invention has improved heat conductivity compared to the prior art and improved tensile strength, in particular strength in the valve crosspiece. Owing to the combination of high heat conductivity and high strength, the occurrence of thermal fatigue cracks is reduced or their course is stopped or even prevented. In particular, successes are achieved in the range of low temperatures, in particular at temperatures from about 100 to about 400° C. The use of the alloy according to the invention leads to the fact that cracks, which are produced in the high temperature range, cannot progress in the low temperature range, i.e. they remain stationary. The service life of the alloy according to the invention or the cylinder head according to the invention is therefore increased. Added to this is the fact that the alloy according to the invention or the cylinder head according to the invention is more economical than alloys or cylinder heads known from the prior art.

The matrix of the structure of the cast iron alloy according to the invention or of the cylinder head according to the invention is constructed from pearlite with at most about 5%, in particular at most about 3%, ferrite. Ferrite is mentioned as the structure here and not as a phase as in pearlite. The %-details relate here, as in all the structure details mentioned here, to the % fraction with flat grinding. In the particle, the lamellar graphite is present in form I, with more than 80%, preferably more than 90% in arrangement A, and in size 3 or finer (EN ISO 945:1994-09). The special structure has the advantage that the desired properties, i.e. the retention of the mechanical properties and the increase of the heat conductivity are further improved. Lamellar graphite in form I, in distribution A and size 2 is only permissible in low-load regions because of lack of inoculation. In the core, the lamellar graphite may also be present in small fractions of the distribution B, C, D and/or E.

In the edge regions up to a depth of 3 mm, the distribution D+E is permissible up to 100% because of the moulding material influence.

The preferred structure properties are significant, in particular in the thereto mechanically strongly loaded regions with temperature change stress and thermal continuous stress of 20-480° and permanently 300-450° C. of the cast iron alloy according to the invention or of the cylinder head according to the invention. These are more secondary at other points.

In conjunction with cylinder heads, this means optimal properties when the above-specified structure is present on the crosspieces between the inlet and outlet valve openings, or in multi-valves, between the crosspieces.

A heat treatment by targeted cooling or annealing treatment for internal stress reduction is optionally possible, but does not influence the metallographic structure composition at all.

The desired properties are adjusted in particular by the combination of the additives given and their quantities, i.e. the latter act together in a synergistic manner.

Carbon is used in a quantity of 2.80% by weight to 3.60% by weight, preferably 3.20% by weight to 3.50% by weight and particularly preferably 3.30% by weight to 3.50% by weight. Too low a carbon content leads to the formation of microcavities, while too high a carbon content has the drawback that the alloy has too low a strength.

Silicon is used in a quantity of 1.00% by weight to 1.70% by weight, preferably in a quantity of 1.20% by weight to 1.60% by weight and particularly preferably in a quantity of 1.30% by weight to 1.50% by weight. Too low a silicon content leads to a tendency to chilling, while too high a silicon content has the drawback that the heat conductivity drops greatly.

Manganese is used in a quantity of 0.10% by weight to 1.20% by weight, preferably in a quantity of 0.30% by weight to 0.80% by weight and particularly preferably in a quantity of 0.50% by weight to 0.60% by weight. Manganese is required to bind the sulphur as no pure sulphur is to be present in the alloy according to the invention, but only manganese sulphide. Too high a manganese content leads to a tendency to chilling.

Sulphur is used in a quantity of 0.03% by weight to 0.15% by weight, preferably in a quantity of 0.05% by weight to 0.14% by weight and particularly preferably in a quantity of 0.08% by weight to 0.12% by weight. Sulphur is required in the compound of MnS in order to ensure good processability. Too little sulphur leads to the fact that the alloy according to the invention is difficult to process. Too high a sulphur content leads to structure defects.

Chromium is used in a quantity of 0.05% by weight to 0.30% by weight, preferably in a quantity of 0.08% by weight to 0.20% by weight and particularly preferably in a quantity of 0.08% by weight to 0.15% by weight. Chromium has the object of stabilising the pearlite at temperatures of >550° C. Too high a chromium content leads to a tendency to chilling.

Molybdenum is used in a quantity of 0.05% by weight to 0.30% by weight, preferably in a quantity of 0.10% by weight to 0.25% by weight and particularly preferably in a quantity of 0.10% by weight to 0.20% by weight. Molybdenum ensured the heat resistance, preferably in the range of 300° C. to 400° C. in the cylinder head application. Too high a molybdenum content increases the alloy costs and leads to a tendency to cavities.

Tin is used in a quantity of 0.05% by weight to 0.20% by weight, preferably in a quantity of 0.05% by weight to 0.15% by weight and particularly preferably in a quantity of 0.08% by weight to 0.12% by weight. Tin is used to prevent the ferrite formation. Too high a tin content leads to brittleness. Tin is quite particularly preferably present in a quantity of 0.08-0.12% by weight.

The cast iron alloy according to the invention or the cylinder head according to the invention may contain the usual impurities. Examples of possible impurities are nickel, copper, titanium, vanadium, niobium, nitrogen, phosphorus. The term impurity also includes inoculants, if one or more of the elements of the inoculant are not necessary to represent the alloy properties.

The quantity of nickel is preferably up to 1% by weight, particularly preferably up to 0.30% by weight, quite particularly preferably <0.1%.

Copper is preferably present in a quantity of up to 1% by weight, particularly preferably up to 0.30% by weight, quite particularly preferably <0.30% by weight. Too high a copper quantity leads to precipitation problems and is expensive. In a preferred embodiment, the use of copper is not necessary at all or the alloy according to the invention contains only the copper coming from the scrap.

Titanium is preferably present in a quantity of a maximum of 0.020% by weight, particularly preferably up to a maximum of 0.010% by weight. Too high a titanium content impairs the processability of the cast iron alloy.

Vanadium is preferably present in a quantity of up to 0.2% by weight, particularly preferably of up to 0.1% by weight, quite particularly preferably <0.10% by weight. If the vanadium content is too high, the toughness and the heat conductivity decrease.

Niobium is preferably present in a quantity of up to 0.2% by weight, particularly preferably of up to 0.1% by weight, quite particularly preferably <0.10% by weight. Too high a niobium fraction increases the costs if added deliberately and leads to an impairment of the heat conductivity.

Nitrogen is preferably present in a quantity of up to 0.03% by weight, particularly preferably of up to 0.0080% by weight. Too high a nitrogen content has the drawback that porosities may be present in the cast part.

Phosphorus is preferably present in a quantity of up to 0.15% by weight, particularly preferably in a quantity of up to 0.06% by weight. Too high a phosphorus content leads to a decrease in the toughness.

The inoculation of the alloy preferably takes place with barium, zirconium or metals of the rare earths. These are used in quantities of 0.0005% by weight to 0.0500% by weight, preferably in quantities of 0.0010% by weight to 0.00125% by weight. Particularly preferred is barium, as the latter brings about a grey solidification as the graphite nucleating agent. Barium is also particularly preferably suitable as it compensates the low silicon quantity as a promoter of the stable solidification. Barium is used in the aforementioned quantities.

The following precise compositions with precisely defined fractions and alloy elements have proven to be particularly favourable:

| | Composition 1 (in % by weight) | Composition 2 (in % by weight) |
|---|---|---|
| Carbon | 3.43 | 3.44 |
| Silicon | 1.42 | 1.40 |
| Manganese | 0.56 | 0.49 |
| Sulphur | 0.10 | 0.11 |
| Chromium | 0.12 | 0.15 |
| Molybdenum | 0.22 | 0.14 |
| Tin | 0.071 | 0.076 |
| Nickel | 0.079 | 0.065 |
| Copper | 0.16 | 0.12 |
| Titanium | 0.005 | 0.006 |
| Vanadium | 0.0011 | 0.015 |
| Niobium | 0.005 | 0.004 |
| Nitrogen | 0.0055 | 0.005 |
| Phosphorus | 0.029 | 0.012 |
| Aluminium | 0.003 | 0.001 |
| Magnesium | 0.002 | 0.001 |
| Arsenic | 0.005 | 0.005 |
| Boron | <0.0001 | <0.0001 |
| Lead | <0.003 | <0.003 |
| Cobalt | 0.016 | 0.025 |
| Antimony | 0.003 | 0.001 |
| Tungsten | 0.002 | <0.001 |
| Zinc | <0.001 | <0.001 |
| Bismuth | 0.0014 | 0.0010 |
| Calcium | 0.0008 | 0.0008 |
| Tellurium | 0.0003 | 0.0003 |
| Cerium | 0.0010 | 0.008 |
| Barium | 0.0008 | 0.0009 |

The graphite in these above-mentioned special compositions is present in the core in form I, arrangement A and size 3 and finer.

The cast iron alloy according to the invention and the cylinder head according to the invention satisfy the required mechanical properties, such as, for example, toughness and hardness. Moreover, heat conductivity measurements have shown that the cast iron alloy according to the invention and the cylinder head according to the invention precisely in the temperature range of about 100 to about 400° C. have unexpectedly high heat conductivity values. The cast iron alloy according to the invention or the cylinder head according to the invention preferably has a heat conductivity of 47 W/mk in the range of 200° C. and corresponds, in temperature ranges of greater than 400°, approximately to known cast iron alloys or cylinder heads. The tensile strength is also improved or at least equivalent in comparison with known alloys.

As already mentioned repeatedly, the invention also relates to a cylinder head. This is preferably a cylinder head of an internal combustion engine. In particular, the cylinder head is a series cylinder head for a single-cylinder or multi-cylinder, in particular a self-igniting, internal combustion engine configured in series or a V-design.

The optimisation of the heat conductivity, while retaining all other required mechanical properties, particularly comes to the fore in components with water cooling, as temperatures of about 100° C. to about 350° C., in particular to about 250° C. are present here in the contact zone to the water flow, and an increased heat conductivity lowers the component temperature in this range more strongly.

The invention will be further described below with the aid of examples. The examples are, however, in no way limiting or restricting to the subject of the present invention.

EXAMPLES 1 TO 4

The following cast iron alloys made of alloyed lamellar graphite cast iron were produced in the conventional manner using barium as the inoculant (Examples 1 and 2) or without an inoculant (Comparative Examples 3 and with an unknown inoculant benchmark 4):

| | Example 1 (in % by weight) | Example 2 (in % by weight) | Comparative Example 3 (in % by weight) | Comparative Example 4 (in % by weight) |
|---|---|---|---|---|
| Carbon | 3.43 | 3.44 | 3.56 | 3.36 |
| Silicon | 1.42 | 1.40 | 2.22 | 1.96 |
| Manganese | 0.56 | 0.49 | 0.73 | 0.58 |
| Sulphur | 0.10 | 0.11 | 0.08 | 0.095 |
| Chromium | 0.12 | 0.15 | 0.10 | 0.32 |
| Molybdenum | 0.22 | 0.14 | 0.098 | 0.023 |
| Tin | 0.071 | 0.076 | 0.076 | 0.020 |
| Nickel | 0.079 | 0.065 | 0.066 | 0.078 |
| Copper | 0.16 | 0.12 | 0.16 | 0.43 |
| Titanium | 0.005 | 0.006 | 0.006 | 0.01 |
| Vanadium | 0.0011 | 0.015 | 0.009 | 0.015 |
| Niobium | 0.005 | 0.004 | 0.006 | 0.005 |
| Nitrogen | 0.0055 | 0.005 | — | 0.0064 |
| Phosphorus | 0.029 | 0.012 | 0.26 | 0.063 |
| Aluminium | 0.003 | 0.001 | 0.002 | 0.002 |
| Magnesium | 0.002 | 0.001 | 0.003 | <0.001 |
| Arsenic | 0.005 | 0.005 | 0.011 | 0.015 |
| Boron | <0.0001 | <0.0001 | <0.0001 | <0.001 |
| Lead | <0.003 | <0.003 | <0.003 | <0.003 |
| Cobalt | 0.016 | 0.025 | 0.021 | 0.012 |
| Antimony | 0.003 | 0.001 | 0.004 | 0.004 |
| Tungsten | 0.002 | <0.001 | 0.002 | 0.002 |
| Zinc | <0.001 | <0.001 | <0.001 | <0.001 |
| Bismuth | 0.0014 | 0.0010 | — | <0.001 |
| Calcium | 0.0008 | 0.0008 | — | — |
| Tellurium | 0.0003 | 0.0003 | — | — |
| Cerium | 0.0010 | 0.008 | — | — |
| Barium | 0.0008 | 0.0009 | — | — |

— = not determined

The matrix of the structure in Examples 1 and 2 consists of pearlite with about 5% ferrite. The lamellar graphite in Examples 1 and 2 is present in form I, arrangement A and size 3 and finer. In the Comparative Examples 3 and 4, the lamellar graphite is present in form I, arrangement A and size 3-5.

The mechanical properties and the heat conductivity of the cast iron alloys of Example 1 and the Comparative Examples 3 and 4 were determined in the usual manner.

The results are shown in the following Table 1 and in FIG. 1.

TABLE 1

Heat conductivity measurements (on temperature conductivity by the laser flash method) and tensile strength values (Rm to DIN EN 10002-1)

| | Example 1 | Comparative Example 3 | Comparative Example 4 |
|---|---|---|---|
| 20° C. | 55.17 | 55.14 | 47.95 |
| 100° C. | 51.22 | 45.86 | 45.4 |
| 200° C. | 47.89 | 39.96 | 43.58 |
| 400° C. | 42.28 | 39.01 | 40.23 |
| 500° C. | 40.06 | 38.24 | 39.02 |
| 550° C. | 38.83 | 37.66 | 38.03 |
| 600° C. | 37.86 | 37.27 | 36.82 |
| Rm [MPa] | 292-328 | 217-257 | 270-310 |

The values for the tensile strength (to DIN EN 10 002) with the tensile specimen to DIN EN 1561, the Brinell hardness (to DIN EN ISO 6506) of Example 1 correspond to the values of the Comparative Examples 3 and 4.

It was shown that the cast iron alloy according to the invention of Example 1 corresponds to the cast iron alloys according to the Comparative Examples 3 and 4 with regard to the tensile strength and hardness but that the cast iron alloy according to the invention is clearly superior to Comparative Examples 3 and 4 with respect to the heat conductivity.

The invention claimed is:

1. A lamellar graphite cast iron alloy, characterized in that the cast iron alloy has as additives 2.80% by weight-3.60% by weight carbon (C),
1.00° A) by weight-1.70% by weight silicon (Si),
0.10% by weight-1.20% by weight manganese (Mn),
0.03% by weight-0.15% by weight sulphur (S),
0.05% by weight-0.30% by weight chromium (Cr),
0.05% by weight-0.30% by weight molybdenum (Mo),
0.05% by weight-0.20% by weight tin (Sn)
and the usual impurities; and
wherein a matrix of a structure of the cast iron alloy is constructed from pearlite with at most about 5% ferrite.

2. The cast iron alloy according to claim 1, characterized in that silicon (Si) is present in a quantity of 1.00% by weight to 1.50% by weight.

3. A lamellar graphite cast iron alloy characterized in that the cast iron alloy has, as additives 3.20% by weight-3.50% by weight carbon (C),
1.30% by weight-1.50% by weight silicon (Si),
0.50% by weight-0.60% by weight manganese (Mn),
0.08% by weight-0.12% by weight sulphur (S),
0.10% by weight 0.15% by weight chromium (Cr),
0.20% by weight-0.25% by weight molybdenum (Mo),
0.05% by weight-0.10% by weight tin (Sn)
and the usual impurities; and
wherein a matrix of a structure of the cast iron alloy is constructed from pearlite with at most about 5% ferrite.

4. The cast iron alloy according to anyone of the preceding claims, characterized in that of the usual impurities the following are present: up to 1% by weight nickel (Ni), up to 1% by weight copper (Cu), up to 0.2% by weight titanium (Ti), up to 0.2% by weight vanadium (V), up to 0.2% by weight niobium (Nb), up to 0.03% by weight nitrogen (N) and up to 0.15% by weight phosphorus (P).

5. The cast iron alloy according to claim 1 or 3, characterized in that the lamellar graphite in a particle is present in form I, with more than 80% in arrangement A and in size 3 or finer (EN ISO 945:1994-09).

6. The cast iron alloy according to claim 1 or 3, obtainable by inoculation with 0.0005% by weight to 0.0500% by weight barium.

7. A cylinder head, cast from the cast iron alloy according to claims 1 or 3.

8. The cylinder head according to claim 7, characterized in that the cylinder head is of an internal combustion engine.

9. The cylinder head according to claim 7, characterized in that the cylinder is configured as a series cylinder head for a multi-cylinder engine.

10. The cylinder head according to either of claim 8, characterized in that the cylinder is configured as a series cylinder head for a multi-cylinder engine.

11. The cast iron alloy according to claim 6 obtainable by inoculation with 0.0010% by weight to 0.00125% by weight barium.

12. A lamellar graphite cast iron alloy component, characterized in that the cast iron alloy has the following constituents:

2.80% by weight-3.60% by weight carbon (C),
1.00% by weight-1.70% by weight silicon (Si),
0.10% by weight-1.20% by weight manganese (Mn),
0.03% by weight-0.15% by weight sulphur (S),
0.05% by weight-0.30% by weight chromium (Cr),
0.05% by weight-0.30% by weight molybdenum (Mo),
0.05% by weight-0.20% by weight tin (Sn)
and usual impurities, the balance iron, wherein the matrix of the structure of the component from the cast iron alloy is constructed from pearlite with at most about 5% ferrite.

* * * * *